United States Patent [19]

Filippi et al.

[11] Patent Number: 4,968,220

[45] Date of Patent: Nov. 6, 1990

[54] RADIAL PISTON PUMP, PARTICULARLY A FUEL INJECTION PUMP FOR DIESEL ENGINES

[76] Inventors: Renato Filippi, Via Parisetto 31, 10048 Vinovo (Torino); Sergio Turchi, Via Bussoleno 16, 10040 Rivalta (Torino); Alessandro Valetto, Via Castellino 11, 10141 Torino, all of Italy

[21] Appl. No.: 236,901

[22] Filed: Aug. 25, 1988

[30] Foreign Application Priority Data

Aug. 25, 1987 [IT] Italy ..... 67739 A/87

[51] Int. Cl.[5] ..... F04B 27/04

[52] U.S. Cl. ..... 417/273

[58] Field of Search ..... 417/269, 273, 270

[56] References Cited

U.S. PATENT DOCUMENTS

| | | | |
|---|---|---|---|
| 2,617,360 | 11/1952 | Barker | 91/501 X |
| 2,801,596 | 8/1957 | Sewell | 417/270 |
| 3,306,211 | 2/1967 | Kunzler et al. | 417/269 X |
| 3,433,124 | 3/1969 | Parrett | 91/501 |
| 3,945,766 | 3/1976 | Gelon | 417/273 |
| 4,684,143 | 8/1987 | Sato | 417/273 X |
| 4,730,986 | 3/1988 | Kayukawa et al. | 417/270 X |

FOREIGN PATENT DOCUMENTS

| | | | |
|---|---|---|---|
| 1096750 | 1/1961 | Fed. Rep. of Germany | 417/273 |
| 1453664 | 3/1969 | Fed. Rep. of Germany . | |
| 366337 | 4/1906 | France . | |
| 1231256 | 5/1986 | U.S.S.R. | 417/273 |
| 966635 | 8/1964 | United Kingdom . | |

*Primary Examiner*—Leonard E. Smith

*Attorney, Agent, or Firm*—Dvorak and Traub

[57] ABSTRACT

A pump with a body formed by two elements sealingly clamped together, between which is defined a central chamber in which a drive shaft carrying an eccentric is rotatably mounted. A plurality of cylinders which open into the central chamber are arranged radially around the shaft in one element of the body, and pistons which cooperate with the eccentric are slidably mounted therein. These cylinders are in communication with a supply chamber defined between the first and second elements. The supply chamber is annular in shape and is formed in a position radially outside the central chamber. At least one sealing member separates the supply chamber from the central chamber. At least one passage is formed in one of the elements to put the supply chamber into communication with the central chamber. An electrically-controlled device controls the flow of fluid through the passage in a predetermined manner.

4 Claims, 2 Drawing Sheets

RADIAL PISTON PUMP, PARTICULARLY A FUEL INJECTION PUMP FOR DIESEL ENGINES

The present invention relates to a radial piston pump and, more specifically, to a radial piston pump comprising a body formed by two elements sealingly clamped together, between which there is defined a central chamber in which a drive shaft carrying an eccentric is rotatably mounted. A plurality of cylinders which open into the central chamber and are disposed radially around the shaft are mounted in one element of the body and pistons which cooperate with the eccentric are slidably mounted therein. The cylinders are able to communicate with a supply chamber defined in the body between the first and second elements. The supply chamber is annular in shape and formed in a position radially outside the central chamber. Sealing means for separating the supply chamber from the central chamber are provided between the first and second elements of the body.

The pump according to the invention is characterised in that at least one passage is formed in one of the elements of the pump body and is able to put the supply chamber into communication with the central chamber; electrically-operated control means being provided for enabling the controlled flow of fluid through the said passage.

By means of these control means (which may comprise, for example, a solenoid cut-off valve which can be piloted in an on/off mode by means of an electrical control signal, or a solenoid flow modulating valve) it is possible at the extreme to prevent communication between the supply chamber and the central chamber of the pump or, in some circumstances, when useful, to enable controlled communication between the central chamber and the supply chamber, for example, when slight pre-heating of the fuel to be pumped would be useful.

Further characteristics and advantages of the present invention will become clear from the detailed description which follows with reference to the appended drawings, provided by way of non-limiting example, in which.

Figure 1:
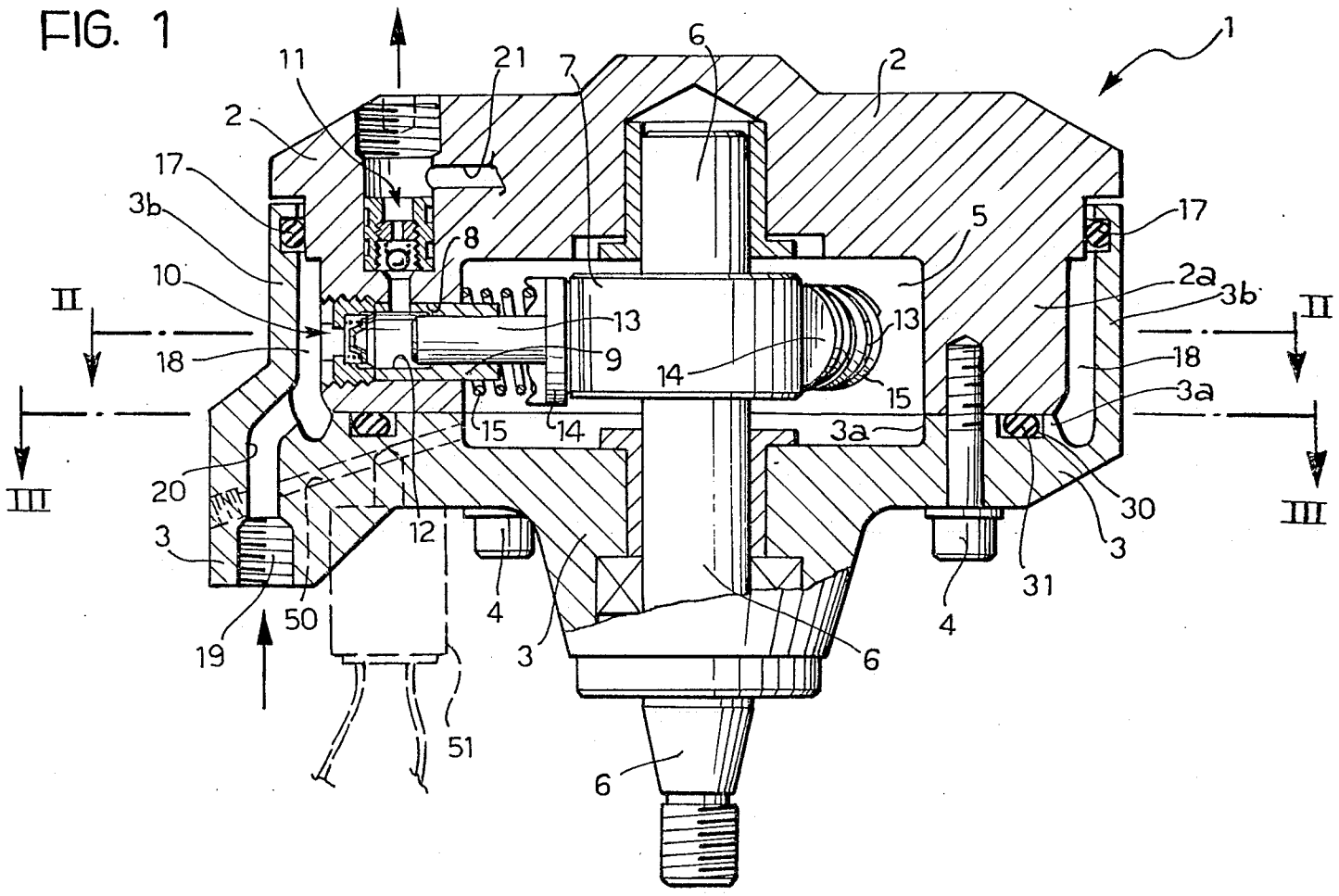
FIG. 1 is an axial section of a radial piston pump according to the invention.
Figure 2:
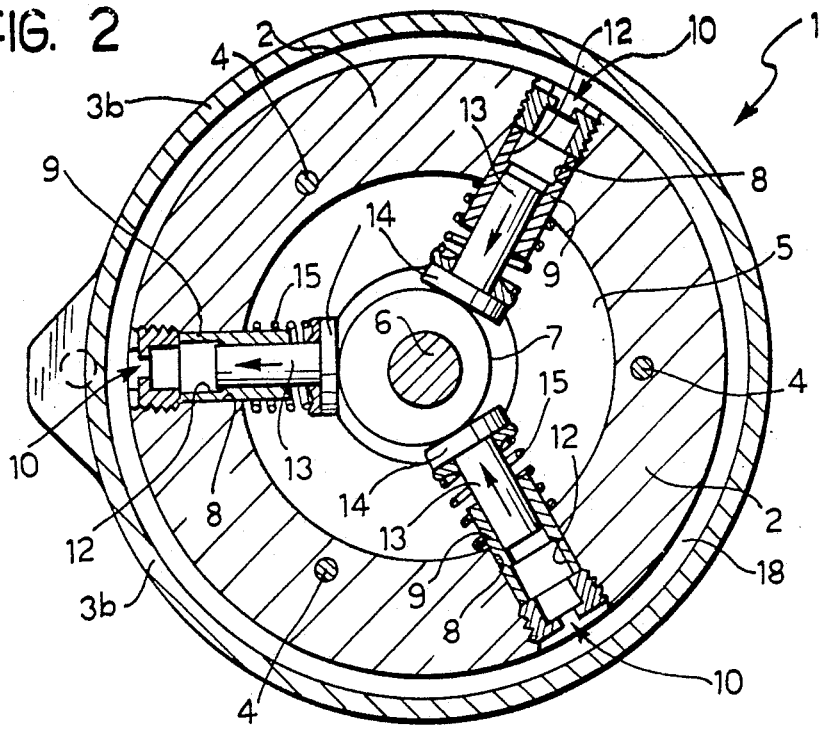
FIGS. 2 and 3 are cross-sections taken on the lines II—II and III—III of FIG. 1.
Figure 3:
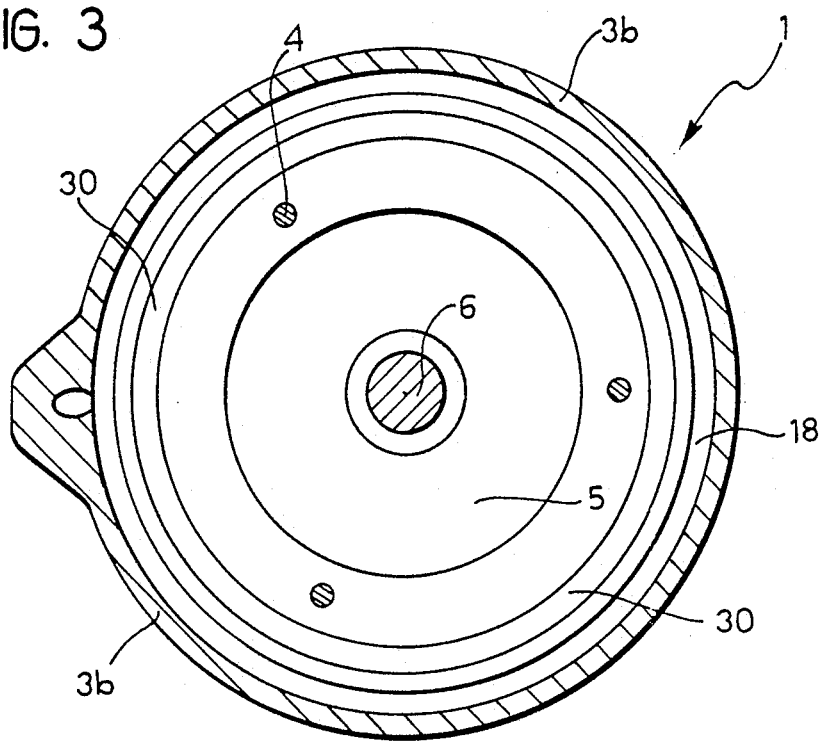

With reference to the drawings, a radial piston pump 1 according to the invention comprises a body formed by two elements 2 and 3 clamped together by means of bolts 4.

In the embodiment illustrated, the element 2 has an annular projection, indicated 2*a*, on its face facing the element 3. The element 3 of the pump body has a corresponding annular projection 3*a* facing and in contact with the end surface of the projection 2*a* of the element 2.

A central cavity or chamber is indicated 5 and is defined between the elements 2 and 3 of the pump body. A drive shaft 6 carrying an eccentric 7 is rotatably mounted in this chamber.

Three equi-angularly spaced apertures 8 are formed in the projecting portion 2*a* of the element 2 of the pump body, the axes of which intersect in correspondence with the axis of the drive shaft 6. A cylinder 9 is fixed in each of these apertures and is provided in known manner with an intake valve and a controlled valve, generally indicated 10 and 11 respectively. A respective piston 13 is mounted for sliding in the working chamber 12 formed in each cylinder. The end of each piston 13 facing the shaft 6 has a head 14 against which acts a helical spring 15 disposed around the cylinder and tending to urge the piston towards the eccentric 7.

The element 3 of the pump body is substantially cup-shaped and has a side wall 3*b* which surrounds the projecting portion 2*a* of the element 2 of the body with clearance.

A sealing ring 17 (FIG. 1) is clamped between the upper portion of the wall 3*b* of the element 3 and the portion facing the outer latera surface of the element 2 of the pump body.

An annular chamber defined in the pump body between the side wall 3*b* and the projecting portion 2*a* of the element 2 is indicated 18. This annular chamber acts as a supply or intake chamber of the pump and communicates with an inlet connector 19 (FIG. 1) through a passage, indicated 20. The liquid which is to be pumped is supplied through this connector. In the case of a fuel injection pump in a diesel engine, this liquid is diesel oil.

The working chamber 12 of each cylinder can be put into communication with the chamber 18 through the respective intake valve 10, when the piston 13 effects its induction stroke under the action of the spring 15 which tends to keep it in contact with the surface of the eccentric 7. This working chamber can be put into communication with a delivery manifold through the respective delivery valve 11, however, when the associated piston 13, pushed by the eccentric 7, effects its delivery stroke.

An annular recess 30 housing a sealing ring 31 (FIG. 1) is formed in that surface of the projecting portion 3*a* of the element 3 of the pump body which is in frontal contact with the projecting portion 2*a* of the element 2. This sealing ring, which is clamped between the two elements 2 and 3 of the pump body, ensures the sealed separation of the central chamber 5 from the supply chamber 18 of the pump.

Operating conditions can actually occur in which controlled pre-heating of the fuel to be pumped may be useful or desirable. With the pump according to the invention it is possible to achieve such controlled pre-heating of the fuel.

In the operation some fuel inevitably leaks between the pistons 13 and the cylinders 9 and flows into the central chamber 5. The fuel thus leaked into the chamber 5 is at a high temperature.

The central chamber 5 of the pump can be put into communication with the chamber 18 through a passage illlustrated by broken lines in FIG. 1 and indicated 50. An electrically-operated control device 51 is associated with this passage and is adapted to control the flow of fuel between the chambers 5 and 18 through the passage 50. The control device 51 may comprise, for example, a solenoid cut-off valve which can be piloted in an on/off mode by means of an electrical control signal, or a solenoid flow-modulating valve.

The passage 50 may be closed completely by the contorl device 51, and in this case, the temperature of the fuel within the central chamber tends to incrrease without noticeably affecting the temperature of the fuel which is being pumped.

Moreover, the device 51 may be piloted so as to allow some communication between the chambers 5 and 18 in some circumstances, with a consequent increase in the temperature of the fuel pumped.

We claim:

1. A radial piston pump, especially a fuel injection pump for a Diesel engine, comprising a pump body formed of two elements sealingly clamped together and defining therebetween a central chamber; a drive shaft rotatably mounted in said body and carrying an eccentric in said central chamber; a plurality of cylinders slidably mounted in one of said elements, extending into said central chamber, disposed radially around said shaft in angularly spaced relationship to each other, and having pistons therein cooperating with said eccentric; a supply chamber arranged between said two elements, for suplying fuel to said cylinders, said supply chamber bering annular in shape and located radially outwardly from said central chamber; sealing means arranged between said two elements and separating said supplying chamber from said central chamber; means for heating the fuel supply; said means including at least one passage formed in one of said elements and providing communication between said two chambers; and an electrically-operated control means in said passage for permitting controlled flow of a first fuel heated during leakage from said cylinders to said central chamber, from said central chamber to said supply chamber, whereby said supply fuel is heated as a result of the readdition of said first heated fuel from the central chamber to said supply fuel chamber.

2. A radial piston pump according to claim 1, wherein said one element has an annular projection facing the other element, said cylinders being arranged in equi-angularly spaced apertures in said one element, the other element having a surface clamped in contact with said projection, and said sealing means being interposed between said surface and said projection.

3. A radial piston pump according to claim 2, wherein said other element is substantially cup shaped and has side walls surrounding said projection in spaced relationship thereto and defining said supply chamber.

4. A radial piston pump according to claims 1, wherein said control means comprises a solenoid cut-off valve adapted to be controlled in an on/off mode by an electrical control signal.

* * * * *

UNITED STATES PATENT AND TRADEMARK OFFICE

CERTIFICATE OF CORRECTION

PATENT NO. : 4,968,220

DATED : November 6, 1990

INVENTOR(S) : Renato FILIPPI, Sergio TURCHI and Alessandro VALETTO

It is certified that error appears in the above-identified patent and that said Letters Patent is hereby corrected as shown below:

On the title page:
Insert --Assignee: WEBER S.r.l., Torino, Italy--.

Signed and Sealed this

Twenty-fifth Day of August, 1992

*Attest:*

DOUGLAS B. COMER

*Attesting Officer*

*Acting Commissioner of Patents and Trademarks*